US010074906B2

(12) United States Patent
Ham

(10) Patent No.: US 10,074,906 B2
(45) Date of Patent: Sep. 11, 2018

(54) HORIZONTALLY POLARIZED WAVE ANTENNA USING SERIAL-FEED MODE

(71) Applicant: MANDO CORPORATION, Pyeongtaek-si, Gyeonggi-do (KR)

(72) Inventor: Hyung Suk Ham, Yongin-si (KR)

(73) Assignee: MANDO CORPORATION, Pyeongtaek-Si, Gyeonggi-Do (KR)

( * ) Notice: Subject to any disclaimer, the term of this patent is extended or adjusted under 35 U.S.C. 154(b) by 3 days.

(21) Appl. No.: 15/297,148

(22) Filed: Oct. 19, 2016

(65) Prior Publication Data

US 2017/0117632 A1 Apr. 27, 2017

(30) Foreign Application Priority Data

Oct. 22, 2015 (KR) ..... 10-2015-0147485

(51) Int. Cl.
*H01Q 9/04* (2006.01)
*H01Q 1/32* (2006.01)
(Continued)

(52) U.S. Cl.
CPC ..... *H01Q 9/045* (2013.01); *H01Q 1/325* (2013.01); *H01Q 1/3233* (2013.01); *H01Q 1/48* (2013.01); *H01Q 11/04* (2013.01)

(58) Field of Classification Search
CPC ..... H01Q 1/32; H01Q 9/0407; H01Q 11/04; H01Q 21/065; H01Q 1/38; H01Q 19/005
(Continued)

(56) References Cited

U.S. PATENT DOCUMENTS 3,409,893 A * 11/1968 Siukola ..... H01Q 19/106 343/806
2007/0279303 A1* 12/2007 Schoebel ..... H01Q 21/0075 343/713

(Continued)

FOREIGN PATENT DOCUMENTS

JP 2010-161543 A 7/2010
KR 10-2012-0130615 A 12/2012
WO 00/65686 A1 11/2000

OTHER PUBLICATIONS

German Office Action dated Jul. 4, 2017 for German Patent Application No. 10 2016 012 729.5.

(Continued)

*Primary Examiner* — Dameon E Levi
*Assistant Examiner* — Hasan Islam
(74) *Attorney, Agent, or Firm* — Hauptman Ham, LLP

(57) ABSTRACT

The present invention is related to a horizontally polarized wave antenna using a serial-feed mode. The antenna includes: a feeder line configured to receive a current supplied from a feeder unit installed to a vehicle; and a patch antenna unit configured to radiate an electromagnetic wave in a horizontal direction while being installed to serially extend in a vertical direction with respect to the ground in a shape that is bent in a zigzag form. The patch antenna unit includes a plurality of first patch elements and a plurality of second patches. With this arrangement, it is possible to realize a horizontally polarized wave with a high resolution by composing vectors of currents flowing in respective patch elements while keeping the entire size of a radar system small.

9 Claims, 4 Drawing Sheets

(51) Int. Cl.
*H01Q 1/48* (2006.01)
*H01Q 11/04* (2006.01)

(58) Field of Classification Search
USPC ..... 343/700 MS, 853, 893, 711–713
See application file for complete search history.

(56) References Cited

U.S. PATENT DOCUMENTS

2008/0007478 A1* 1/2008 Jung ..... H01Q 1/38
343/895
2008/0099881 A1* 5/2008 Jung ..... H01L 27/0676
257/601
2010/0214174 A1* 8/2010 Guan ..... H01Q 1/243
343/700 MS
2015/0236427 A1* 8/2015 Asai ..... H01Q 15/006
343/909

OTHER PUBLICATIONS

Korean Office Action for corresponding Korean Patent Application No. 10-2015-0147485 dated Aug. 16, 2016.

* cited by examiner

HORIZONTALLY POLARIZED WAVE ANTENNA USING SERIAL-FEED MODE

CROSS REFERENCE TO RELATED APPLICATION

This application claims priority from Korean Patent Application No. 10-2015-0147485, filed on Oct. 22, 2015, which is hereby incorporated by reference for all purposes as if fully set forth herein.

BACKGROUND OF THE INVENTION

1. Field of the Invention

The present invention relates to a horizontally polarized wave antenna, and more particularly, to a horizontally polarized wave antenna using a serial-feed mode, which produces a horizontally polarized wave by composing vectors of currents while using an existing serial arrangement mode.

2. Description of the Prior Art

A radar system mounted on a vehicle or the like involves a technology for implementing Intelligent Transportation Systems (ITS), and is a vehicle safe driving system that has been developed in order to prevent, in advance, an accident that may occur due to severe weather conditions or a driver's carelessness by sensing other vehicles or objects.

Such a vehicle radar system separately uses a preferred polarized wave as needed, among various polarized waves having different angles (e.g., a vertically polarized wave, a horizontally polarized wave, a circularly polarized wave, and a 45 degree polarized wave) in order to maximize a radar performance when sensing a reflector. For example, when many vertical structures exist, a horizontally polarized wave antenna is used. When many horizontal structures exist, a vertically polarized wave antenna is used. When weathers may affect, a circularly polarized wave antenna is used. Further, when a middle performance between vertical and horizontal performances is desired, a 45 degree polarized wave antenna is used.

Meanwhile, when a radar system is mounted on a vehicle, a portion for mounting the radar system is limited by various structures, such as an ultrasonic sensor within a bumper, a number plate, a fog lamp, and a support structure, there is no alternative but to limit the size of the radar system. However, in order to have a spatial resolution within a small detection angle, a planar antenna requires a transmission line having a long height component and a radiating element having a wide area so that the entire size of the radar system is enlarged.

Accordingly, the present embodiment represents a horizontally polarized wave antenna that is capable of realizing a horizontal directionality with a high resolution while keeping the entire size of the radar system small.

SUMMARY OF THE INVENTION

Accordingly, the present invention has been made in order to solve the above-described problems in the related art, and an object of the present invention is to provide a horizontally polarized wave antenna using a serial-feed mode, which produces a horizontally polarized wave with a high resolution by composing vectors of currents flowing in respective patch elements while using an existing serial arrangement mode while keeping the entire size of a radar system small by forming a plurality of patch elements to be bent in series.

In order to achieve the object described above, according to one embodiment, there is provided a horizontally polarized wave antenna using a serial-feed mode. The antenna includes: a feeder line configured to receive a current supplied from a feeder unit installed to a vehicle; and a patch antenna unit installed to extend serially in a vertical direction with respect to the vehicle, and configured to radiate an electromagnetic wave in a horizontal direction.

The patch antenna unit may include a plurality of first patch elements and a plurality of second patch elements that are installed to serially extend in the vertical direction with respect to the ground while having a shape that is bent in a zigzag form.

The plurality of first patch elements may be disposed to be inclined at a predetermined first bent angle with respect to a straight line that is parallel with the vehicle, and the plurality of second patch elements may be disposed to be inclined at a predetermined second bent angle with respect to a straight line that is parallel with the vehicle.

The first bent angle and the second bent angle may be equal to each other in magnitude such that a vector sum of currents respectively flowing in the first and second patch elements is horizontal with respect to the vehicle.

When a current is incident on the patch antenna unit from the feeder line, an electromagnetic wave may be radiated from the first patch elements connected to the feeder line, and then, radiation may be induced in the second patch elements connected to the first patch elements such that the electromagnetic wave may be radiated up to a terminal end patch element of the patch antenna unit.

Further, the first patch elements and the second patch elements may be integrally formed using the same material.

Each of the first patch elements and the second patch elements may have a length of a ½ wavelength of the current flowing in the feeder line.

At another end that is opposite to the one end to which the feeder line of the patch antenna element is connected, the antenna may further include an antenna element configured to efficiently radiate a residual power, or a matching terminal end element configured to absorb the residual power.

As described above, with the horizontally polarized wave antenna using a serial-feed mode according to the present embodiment, it is possible to realize a horizontally polarized wave that is parallel with the ground by composing an arrangement of currents while the entire antenna is arranged in series in the vertical direction in relation to the ground.

In addition, by forming a plurality of patch elements to be serially bent, which serve not only as radiating elements, but only as transmission lines, it is possible to produce a horizontally polarized wave having an angular resolution with a high resolution while securing the freedom of design by keeping the height and width components of the antenna small.

In addition, because the horizontally polarized wave antenna has a simple structure in which a plurality of patch elements are formed to be serially bent, it is easy to design the antenna.

BRIEF DESCRIPTION OF THE DRAWINGS

The above and other objects, features, and advantages of the present invention will be more apparent from the following detailed description taken in conjunction with the accompanying drawings, in which.

DETAILED DESCRIPTION OF THE EXEMPLARY EMBODIMENTS

Hereinafter, a horizontally polarized wave antenna using a serial-feed mode according to a present embodiment will be described in detail with reference to the accompanying drawings.

The advantages and characteristics of the present invention, and the methods to achieve them, will become apparent from the embodiments to be described in detail below with reference to the accompanying drawings.

However, the present invention is not limited by the embodiments to be described below, but may be implemented in various forms. The embodiments are provided merely to completely disclose the technical idea of the present invention and to completely inform a person ordinarily skilled in the art to which the present invention belongs of a scope of the technical idea. The scope of the present invention is determined only based on the claim.

In addition, when a related publicly known technology or the like may make the gist of the present invention rather unclear in describing the embodiments, detailed descriptions for the related publicly known technology or the like will be omitted.

Meanwhile, while terms, such as "first" and "second," may be used in describing constituent elements of the embodiments, the terms are used merely for differentiating the constituent elements from other constituent elements and the essence, order, sequence, or the like of the corresponding constituent elements is not limited by the terms.

In addition, the term, "feeder line," to be used below may be understood in the meaning of a transmission line. That is, a portion connected to a feeder unit may be referred to as a feeder line, and a line to be spaced away from a feeder unit by a predetermined distance or more may be referred to as a transmission line. However, because the feeder line and the transmission line may be configured as a single line as needed, the feeder line and the transmission line may be collectively referred to as a feeder line or a transmission line.

In addition, the term, "patch element," to be used below means a radiation region (or a radiation element) that radiates a signal. That is, the patch element may be a radiation patch configured on a transmission line, or may mean a region on a transmission line from which a signal is radiated due to the bending or change in thickness of the transmission line. Hereinbelow, although a radiation region is referred to as a patch element for the convenience of description and for helping understanding, it shall be understood as a region from which a signal is radiated as described above.

Figure 1A:
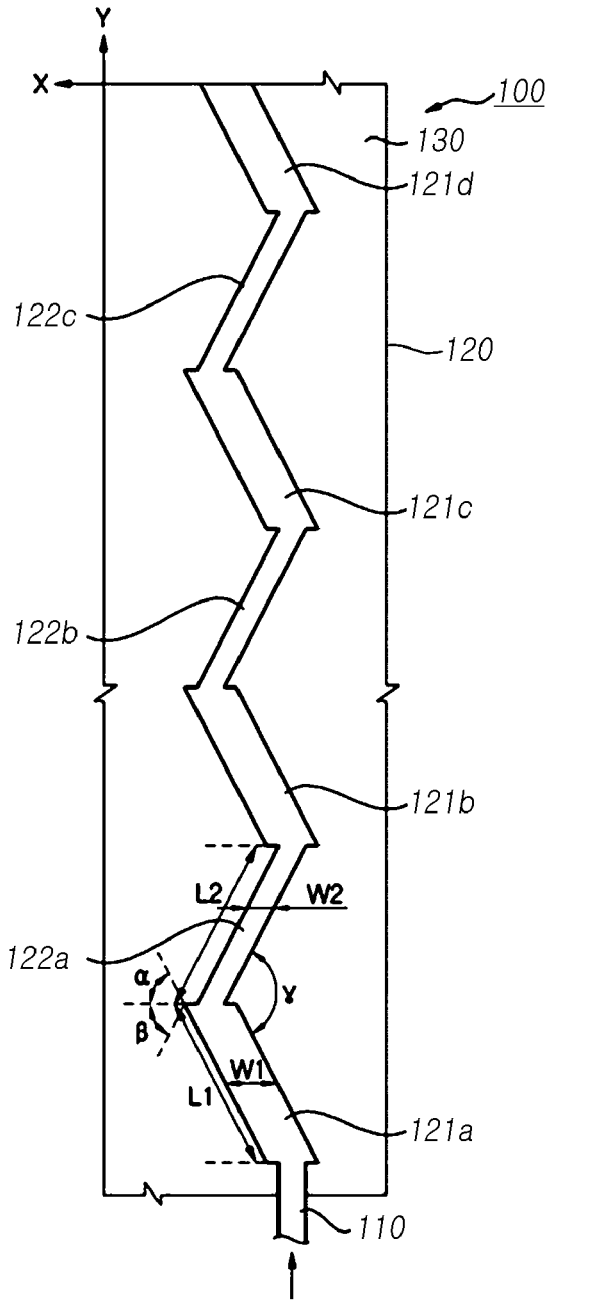
FIG. 1A is a plan view schematically illustrating a horizontally polarized wave antenna of a serial-feed mode according to an embodiment.
Figure 1B:
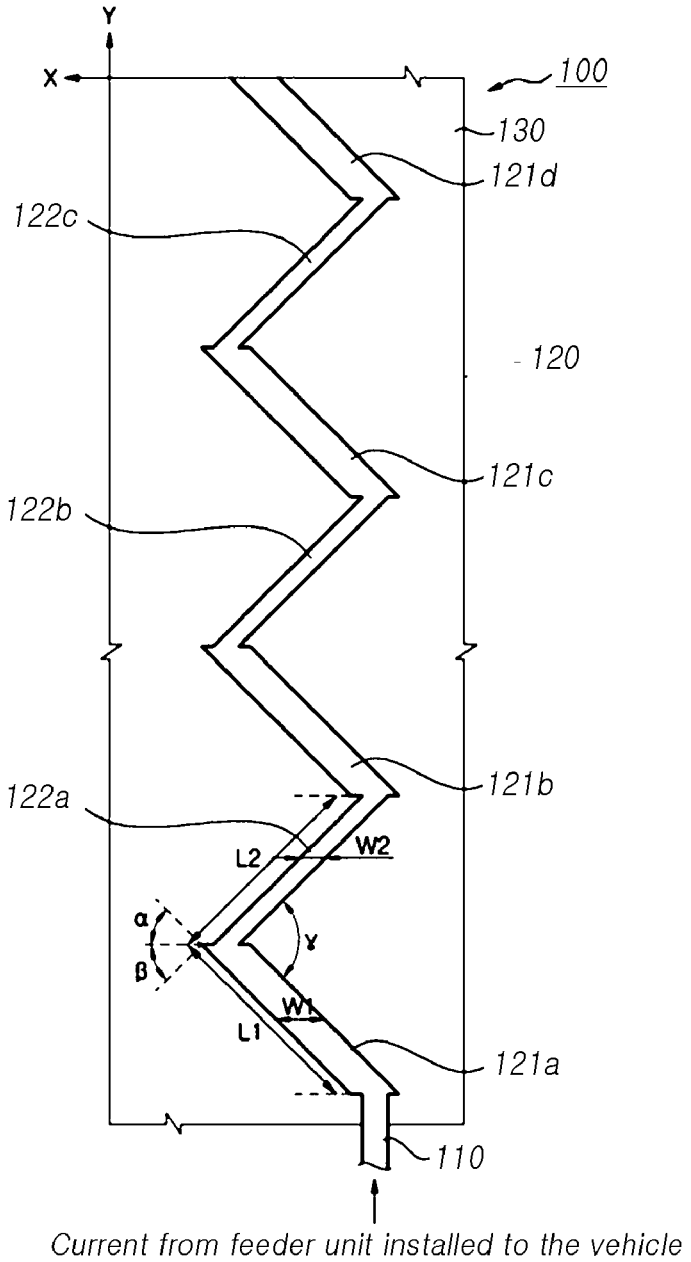
FIG. 1B is a plan view schematically illustrating a horizontally polarized wave antenna of a serial-feed mode according to another embodiment.

FIGS. 1A and 1B are plan views each schematically illustrating a horizontally polarized wave antenna of a serial-feed mode according to one embodiment.

A horizontally polarized wave antenna 100 according to one embodiment is a device that is installed to a vehicle or the like to send/receive an electromagnetic wave to/from a space in order to transmit/receive a polarized wave (a traveling wave, a standing wave, or the like). The horizontally polarized wave antenna 100 may include: a feeder line 110 configured to receive a current from a feeder unit installed to the vehicle; a patch antenna unit 120 constituted with a plurality of first patch elements 121*a*, 121*b*, 121*c*, and so on. as well as a plurality of second patch elements 122*a*, 122*b*, 122*c*, and so on that radiate an electromagnetic wave horizontally while being installed to extend vertically with respect to the vehicle; and a dielectric board 130 that includes a ground plate formed on the rear face thereof.

First, the feeder line 110 of the present embodiment is electrically connected with a feeder unit installed in the vehicle (at the lower side in FIGS. 1A and 1B) at one longitudinal end thereof so as to receive a current from the feeder unit. The current supplied from the feeder unit has a sign wave shape with a wavelength $\lambda_g$. When the supply of the current to the feeder line 110 of the present embodiment is started, the fed currents, each having a half wavelength $\lambda_g/2$, are formed and flow to the first patch elements 121*a*, 121*b*, 121*c*, and so on and the second patch elements 122*a*, 122*b*, 122*c*, and so on of the patch antenna unit to be described later in a bent direction.

Next, the patch unit 120 of the present embodiment includes a plurality of first patch elements 121*a*, 121*b*, 121*c*, and so on and a plurality of second patch element 122*a*, 122*b*, 122*c*, and so on that radiate electromagnetic waves in the horizontal direction while being installed to extend in the vertical direction with respect to the ground or the vehicle.

More specifically, the first patch elements 121*a*, 121*b*, 121*c*, and so on and the second patch elements 122*a*, 122*b*, 122*c*, and so on are entirely installed to extend in a serial mode while having a bent shape in which adjacent first and second patch elements form a predetermined angle $\gamma$ therebetween. In other words, assuming that a straight line that is parallel with the ground (i.e., a straight line that is vertical to the direction in which the patch elements are installed to extend is a virtual straight line X), and a straight line that is vertical to the ground (i.e., a straight line that is parallel with the direction in which the patch elements are installed to extend is a virtual straight line Y) each of the first patch elements 121*a*, 121*b*, 121*c*, and so on is disposed to be inclined by a predetermined first bent angle $\alpha$ in a positive (+) direction with respect to the virtual straight line X, each of the second patch elements 122*a*, 122*b*, 122*c*, and so on is disposed to be inclined by a predetermined second bent angle $\beta$ in a negative (−) direction with respect to the virtual straight line X, and the first patch elements 121*a*, 121*b*, 121*c*, and so on and the second patch elements 122*a*, 122*b*, 122*c*, and so on are installed to extend to be bent in the zigzag form along the virtual straight line Y.

Meanwhile, each of FIGS. 1A and 1B exemplifies a horizontally polarized wave antenna installed to extend vertically with respect to the ground with various bent angles according to one embodiment. At this time, the first bent angle $\alpha$ of the first patch element 121*a* and the second bent angle $\beta$ of the second bent element 122*a* may be set to any angle. However, in order to increase the effect of the horizontally polarized waves and the antenna efficiency, it is desirable to set the magnitudes of the first bent angle $\alpha$ and the second bent anone embodimentgle $\beta$ to be equal to each other, and to set the curved angle $\gamma$ between the first patch element 121*a* and the second bent angle 122*a* as small as possible.

Figure 2:
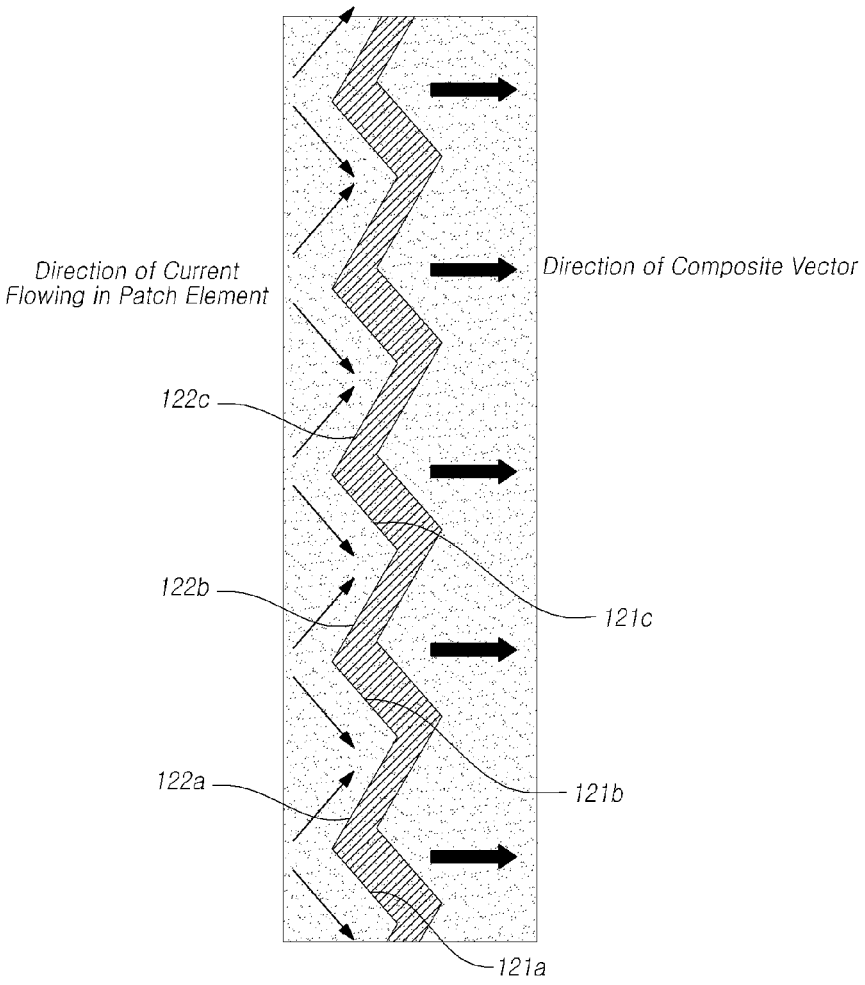
FIG. 2 is a view illustrating a direction of a vector that is composed as a current supplied through a feeder line flows in patch elements.
Figure 3:
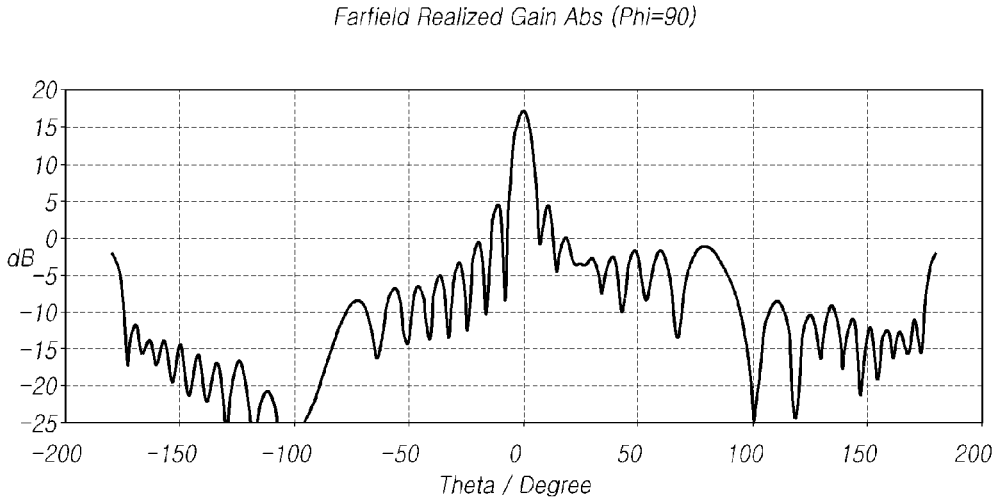
FIG. 3 is a graph illustrating a radiation pattern characteristic of a horizontally polarized wave antenna using a serial-feed mode according to one embodiment.

With this configuration, the sum of vectors of respective currents flowing in the first patch elements 121*a*, 121*b*, 121*c*, and so on and the second patch elements 122*a*, 122*b*, 122*c*, and so on of the present embodiment may be horizontal to the virtual straight line X as illustrated in FIG. 2, and the polarized wave plane (electric field direction) of the patch antenna unit 120 may also be horizontal to the virtual straight line X. In addition, due to this, when the array antenna 100 is used in the state of being disposed vertically to the ground, it is possible to transmit/receive straightly polarized electromagnetic waves that are horizontal to the ground.

In addition, in one embodiment, the first patch elements 121*a*, 121*b*, 121*c*, and so on and the second patch elements 122*a*, 122*b*, 122*c*, and so on are integrally molded using the same material such that each of the patch elements serves not only as a radiating element, but also as a transmission line. That is, in one embodiment, when a current is incident on the patch antenna unit 120 from the transmission line 110, resonance is generated in the first patch element 121*a* at the beginning so that an electromagnetic wave is radiated first, and then, the current flows from the first patch element 121*a* to the second patch element 122*a* such that radiation is induced in the second patch element 122*a* due to an abrupt change in impedance in the curved portion therebetween. In this way, as the radiation of the electromagnetic waves is induced in the second patch element 122*a*, the second patch element 122*a* also serves as a radiating element, and due to this principle, the radiation of electromagnetic waves is implemented up to the terminal end patch element of the patch antenna 120. In this way, since the patch elements 121*a*, 121*b*, 121*c*, and so on and 122*a*, 122*b*, 122*c*, and so on serve not only as radiating elements, but also as transmission lines, and do not require a separate transmission line, the horizontally polarized wave antenna 100 according to one embodiment may be advantageous in that the efficiency of an antenna can be enhanced while reducing the length of the antenna.

Alternatively, the first patch elements 121*a*, 121*b*, 121*c*, and so on are radiating patches, and the second patch elements 122*a*, 122*b*, 122*c*, and so on may be transmission lines. That is, radiating patches are configured to be spaced apart by a predetermined interval from each other on the transmission lines. In this case, as the radiating patches are first patch elements 121*a*, 121*b*, 121*c*, and so on and the width of the radiating patches and the width of the transmission lines become different from each other, the transmission lines each formed between the radiating patches may serve as second patch elements 122*a*, 122*b*, 122*c*, and so on. Of course, the first patch elements 121*a*, 121*b*, 121*c*, and so on may be transmission lines, and the second patch elements 122*a*, 122*b*, 122*c*, and so on may be radiating patches. Alternatively, both the first patch elements 121*a*, 121*b*, 121*c*, and so on and the second patch elements 122*a*, 122*b*, 122*c*, and so on may be transmission lines. That is, by using a characteristic of radiating a signal on the transmission lines due to the curve and change in width of the transmission lines, an antenna function can be executed without a separate radiating patch. Alternatively, both the first patch elements 121*a*, 121*b*, 121*c*, and so on and the second patch elements 122*a*, 122*b*, 122*c*, and so on may be radiating patches. In this case, the first patch elements 121*a*, 121*b*, 121*c*, and so on and the second patch elements 122*a*, 122*b*, 122*c*, and so on may also perform the function of transmission lines.

In addition, the length $L_1$ or $L_2$ each of the first patch element 121*a* and the second patch element 122*a* is about ½ wavelength of a current flowing in the feeder line 110 (e.g., $\lambda_g/2$), and the opposite ends may have the same length in the inclined directions. However, the lengths of the patch elements are variously applicable as needed.

In addition, because the patch antenna unit 120 has a continuously bent shape, its width may be variably adjusted as needed. At this time, the bent widths W1 and W2 of the first patch element 121*a* and the second patch element 122*a* may be formed to be equal to each other, or may be formed to be different from each other as illustrated in FIG. 1. Thus, in the case where the widths of the first patch element 121*a* and the second patch element 122*a* are equal to each other, because the impedances of respective patch elements are approximate to each other and radiation is induced due to a curve, it may be possible to adjust the current amount based on a curved extent, and in the case where the widths of the first patch element 121*a* and the second patch element 122*a* are different from each other, because radiation is induced by a difference in impedance between respective patch elements and a curve, it may be possible to adjust the current amount based on a difference in width and a curved extent. In this way, it is possible to variably adjust each of the widths $W_1$ and $W_2$ of the patch elements depending on various specifications, characteristics, and so on that are required for an antenna as needed. For example, the width W1 of the first patch element 121*a* may be set to be larger than the width W2 of the second patch element 122*a*.

Up to now, the shape of the patch antenna unit 120 according to the present embodiment has been described. However, the patch antenna unit 120 may be manufactured in various shapes as needed without being limited to the above-mentioned shape as long as the shape of the patch antenna 120 may enable the composite vector of the currents flowing in respective patch elements 121*a*, 121*b*, 121*c*, and so on and 122*a*, 122*b*, 122*c*, and so on to be directed horizontally, and particularly, in order to reduce a power loss, the bent portions of the first patch elements 121*a*, 121*b*, 121*c*, and so on and the second patch elements 122*a*, 122*b*, 122*c*, and so on may be formed in a smooth curve according to a bent direction.

Finally, all the patch elements 120 may be manufactured by etching a radiation pattern on a dielectric board 130 (e.g., a PCB) that has a conductor ground plate formed on the rear face thereof, but is not limited thereto.

Additionally, at the other end that is opposite to the one end to which the feeder line 110 is connected, the antenna element 120 may be further provided with an antenna element configured to efficiently radiate a residual power, or a matching terminal end element (not illustrated) configured to absorb the residual power. The matching terminal end element performs a function of radiating all the currents flowing in to the end of the feeder line by performing a matching function, and through this, it is possible to prevent the currents from returning toward the feeder unit by being reflected at the terminal end of the feeder line.

As described above, according to the present embodiment, the horizontally polarized wave antenna using a serial-feed mode is capable of realizing a horizontally polarized wave that is parallel with the ground by composing an arrangement of currents while the entire antenna is arranged in series in the vertical direction in relation to the ground.

In addition, by forming a plurality of patch elements to be serially bent, which serve not only as radiating elements, but only as transmission lines, it is possible to produce a horizontally polarized wave having an angular resolution with a high resolution while securing the freedom of design by keeping the height and width components of the antenna small.

In addition, because the horizontally polarized wave antenna has a simple structure in which a plurality of patch elements are formed to be serially bent, it is easy to design the antenna.

While the present invention has been described in detail above with reference to various embodiments, the technical idea is not necessarily limited to the embodiments, and may be variously modified within a scope that does not depart from the technical idea.

What is claimed is:

1. A horizontally polarized wave antenna using a serial-feed mode to radiate an electromagnetic wave, the antenna comprising:

a feeder line configured to receive a current supplied from a feeder unit installed to a vehicle; and a patch antenna unit installed to extend serially in a vertical direction with respect to a ground, and configured to radiate an electromagnetic wave in a horizontal direction, wherein the patch antenna unit includes a plurality of first patch elements and a plurality of second patch elements that are installed to serially extend in the vertical direction with respect to the ground while having a shape that is bent in a zigzag form, wherein the plurality of first patch elements are disposed to be inclined at a predetermined first bent angle with respect to a straight line that is parallel with the ground, and the plurality of second patch elements are disposed to be inclined at a predetermined second bent angle with respect to a straight line that is parallel with the ground.

2. The antenna of claim 1, wherein the first bent angle and the second bent angle are equal to each other in magnitude such that a vector sum of currents respectively flowing in the first and second patch elements is horizontal with respect to the ground.

3. The antenna of claim 1, wherein, when a current is incident on the patch antenna unit from the feeder line, an electromagnetic wave is radiated from the first patch elements connected to the feeder line, and then radiation is induced in the second patch elements connected to the first patch elements such that the electromagnetic wave is radiated up to a terminal end patch element of the patch antenna unit.

4. The antenna of claim 3, wherein the first patch elements and the second patch elements are integrally formed using a same material.

5. The antenna of claim 1, wherein each of the first patch elements and the second patch elements has a length of a ½ wavelength of the current flowing in the feeder line.

6. The antenna of claim 1, wherein the first patch elements and the second patch elements are radiation patches.

7. A horizontally polarized wave antenna using a serial-feed mode to radiate an electromagnetic wave, the antenna comprising:

a feeder line configured to receive a current supplied from a feeder unit installed to a vehicle; and a patch antenna unit installed to extend serially in a vertical direction with respect to a ground, and configured to radiate an electromagnetic wave in a horizontal direction, wherein the patch antenna unit includes a plurality of first patch elements and a plurality of second patch elements that are installed to serially extend in the vertical direction with respect to the ground while having a shape that is bent in a zigzag form, wherein a width of the first patch elements and a width of the second patch elements are different from each other.

8. The antenna of claim 7, wherein the width of the first patch elements is larger than the width of the second patch elements.

9. A horizontally polarized wave antenna using a serial-feed mode to radiate an electromagnetic wave, the antenna comprising:

a feeder line configured to receive a current supplied from a feeder unit installed to a vehicle; and a patch antenna unit installed to extend serially in a vertical direction with respect to a ground, and configured to radiate an electromagnetic wave in a horizontal direction, wherein the patch antenna unit includes a plurality of first patch elements and a plurality of second patch elements that are installed to serially extend in the vertical direction with respect to the ground while having a shape that is bent in a zigzag form, wherein the antenna further comprises:

an antenna element configured to efficiently radiate a residual power, or a matching terminal end element configured to absorb the residual power at another end that is opposite to the one end to which the feeder line of the patch antenna element is connected.

* * * * *